US006698385B1

(12) United States Patent
Lesage

(10) Patent No.: US 6,698,385 B1
(45) Date of Patent: Mar. 2, 2004

(54) COMBUSTION CHAMBER SHIELD FOR HOT WATER HEATERS

(75) Inventor: Claude Lesage, Pointe Claire (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 10/352,870

(22) Filed: Jan. 29, 2003

(51) Int. Cl.[7] ..... F22B 5/00

(52) U.S. Cl. ..... 122/13.01; 122/17.1; 122/17.2; 122/18.31

(58) Field of Search ..... 122/13.01, 18.3, 122/18.31, 19.2, 17.1, 17.2

(56) References Cited

U.S. PATENT DOCUMENTS 2,240,283 A * 4/1941 Breese ..... 431/13
2,506,336 A * 5/1950 Bock ..... 122/18.1
2,515,919 A * 7/1950 Weyenberg et al. ..... 126/94
2,617,391 A * 11/1952 Raymond ..... 122/17.2
6,237,544 B1 * 5/2001 Croxford et al. ..... 122/14.22

FOREIGN PATENT DOCUMENTS

JP 60134147 A * 7/1985

* cited by examiner

*Primary Examiner*—Jiping Lu
(74) *Attorney, Agent, or Firm*—Ogilvy Renault; Guy Houle

(57) ABSTRACT

A shield for a combustion chamber of a hot water heater is described. The combustion chamber is a sealed or not combustion chamber and the metal heat shield encircles and is spaced about the burner and pilot which is located in the combustion chamber. The shield is also spaced from the skirt and a bottom wall of the combustion chamber. The shield is further provided with apertures to permit passage of air supplied by an air supply duct. The shield provides for heat concentration on a lower heat transfer wall of the inner casing containing the water to be heated. The shield also reduces heat loss through the skirt and the bottom end wall of the combustion housing.

14 Claims, 2 Drawing Sheets

COMBUSTION CHAMBER SHIELD FOR HOT WATER HEATERS

TECHNICAL FIELD

The present invention relates to a shield for a combustion chamber of a gas-fired hot water heater whereby to provide heat concentration in the combustion chamber and on a lower heat transfer wall of the inner casing and also to reduce heat loss through the skirt and the bottom end of the water heater.

BACKGROUND ART

With known gas-fired hot water heaters using combustion chambers, there is a substantial heat loss through the lower skirt of the housing which is disposed adjacent the combustion chamber of the water heater and through the lower end portion of the housing. With the new designs of sealed combustions, combustion air is supplied through a vertical duct which is in registry with a supply hole provided in the skirt and therefore the insulation in that area is reduced. Also, the insulation between the lower skirt and the outer casing is not sufficiently thick and this results in heat loss as sealed combustion chambers become very hot. Accordingly, there is excessive heat loss through the skirt and the lower region of the hot water heater housing and the performance or efficiency of the hot water heater is reduced. There is therefore a need to overcome this problem.

SUMMARY OF INVENTION

It is a feature of the present invention to provide a shield for the combustion chamber of a hot water heater which substantially overcomes the above-mentioned disadvantage of prior art water heaters of this type.

Another feature of the present invention is to provide a shield for the combustion chamber of a hot water heater and which shield reduces heat loss through the skirt and outer casing and the bottom end of the hot water heater housing by about 30 to 50 percent over previous designs.

According to a further broad aspect of the present invention there is provided a shield for the combustion chamber of a hot water heater wherein the heat in the sealed combustion chamber is concentrated on the lower transfer wall of the inner casing while at the same time reducing heat loss through the skirt and the bottom end wall of the housing.

According to above features, from a broad aspect, the present invention provides a shield for a combustion chamber of a hot water heater. The heater has an inner casing for the containment of water to be heated by a combustion chamber disposed under the inner casing. A burner and a pilot are provided in the combustion chamber. A flue pipe extends from the combustion chamber to evacuate combustion gases. An outer casing is secured spaced about the internal casing and insulated therefrom by a thermal insulating material. A support base is provided at a bottom end of the water heater. A skirt is provided about the combustion chamber and spaced internally from a lower end portion of the outer casing. Air passage means is provided to supply air to the combustion chamber. A heat shield, formed of metal, is secured in the combustion chamber and encircles and is spaced about the burner and pilot. The shield is spaced from the skirt. Air aperture means is provided in the shield to permit passage of combustion air supplied through the air passage means. The shield provides heat concentration in the combustion chamber and on a lower heat transfer wall of the internal casing and also reduces heat loss through the skirt and a bottom end of the combustion chamber.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
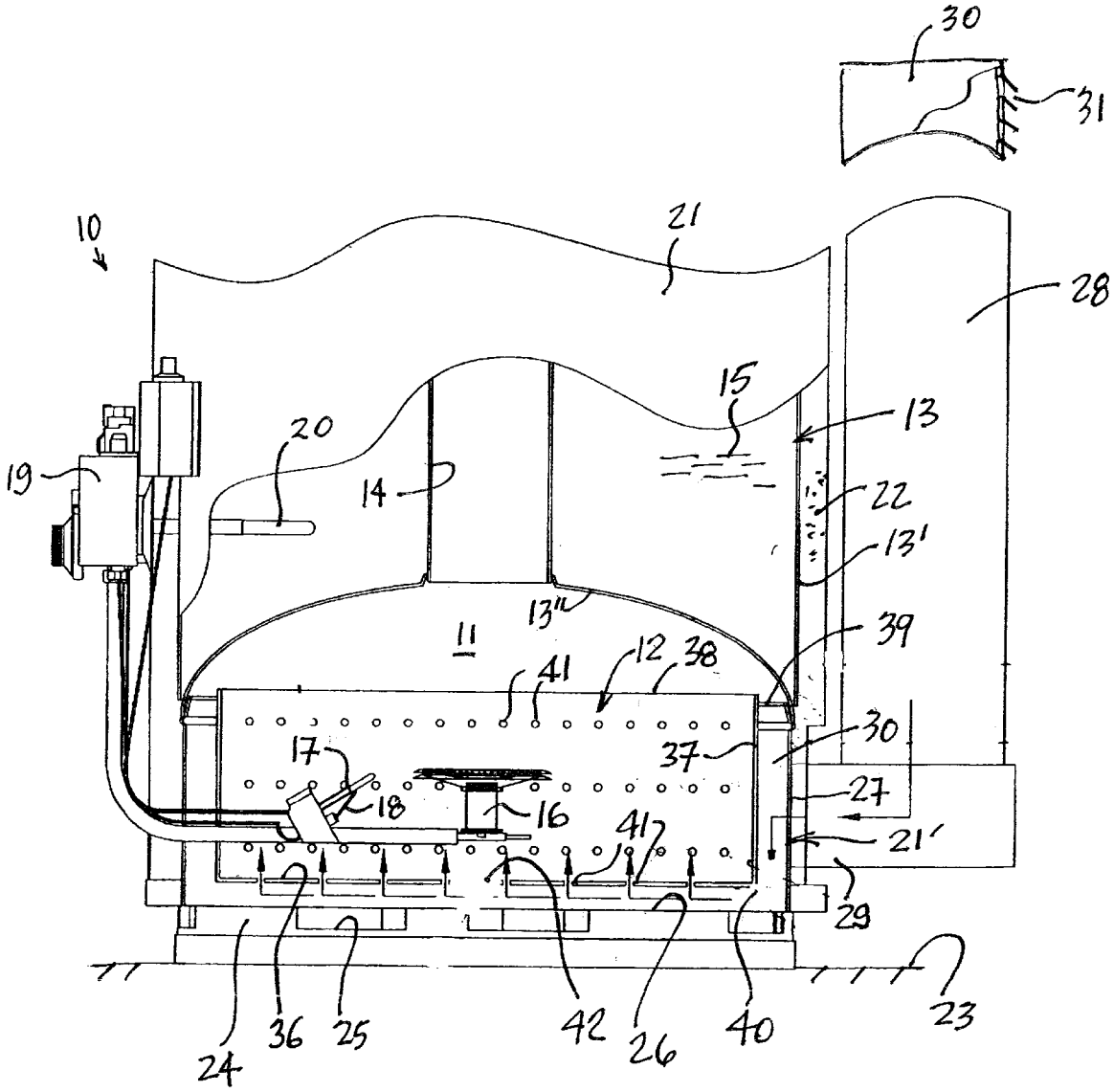
FIG. 1 is a fragmented side view of a hot water heater having a sealed combustion chamber and illustrates a first example of the construction of the shield of the present invention.

Referring to the drawings, and more particularly to FIG. 1, there is shown generally at 10 a lower portion of a hot water heater and which illustrates the basic component parts thereof and more particularly its lower combustion chamber 11 which is provided with the heat shield 12 of the present invention. As hereinshown, the hot water heater has an inner casing 13 which is of elongated cylindrical shape and provided with a central flue 14 extending therethrough and exhausting at a top end in a manner well known in the art. Water 15 to be heated is contained within the inner casing 13 and dispensed therefrom, as is also well known in the art.

The hot water heater as herein illustrated is a gas-fired hot water heater and its sealed combustion chamber 11 is provided with a burner 16 and a pilot 17 which is provided with an igniter 18 to kick-start the burners 16. A control 19 controls the burner and is provided with a water temperature sensor 20 to effectuate this control. This is also well known in the art.

An outer casing or shroud 21 is secured spaced about the inner casing 13 and an insulated material 22 such as identified by the trade mark Green Foam, registered trade mark of Giant Factories Inc., is injected in this space whereby to provide good insulation between the outer wall 13' of the inner casing and the outer casing 21 which is usually a thin metal sheet cylinder.

Figure 2:
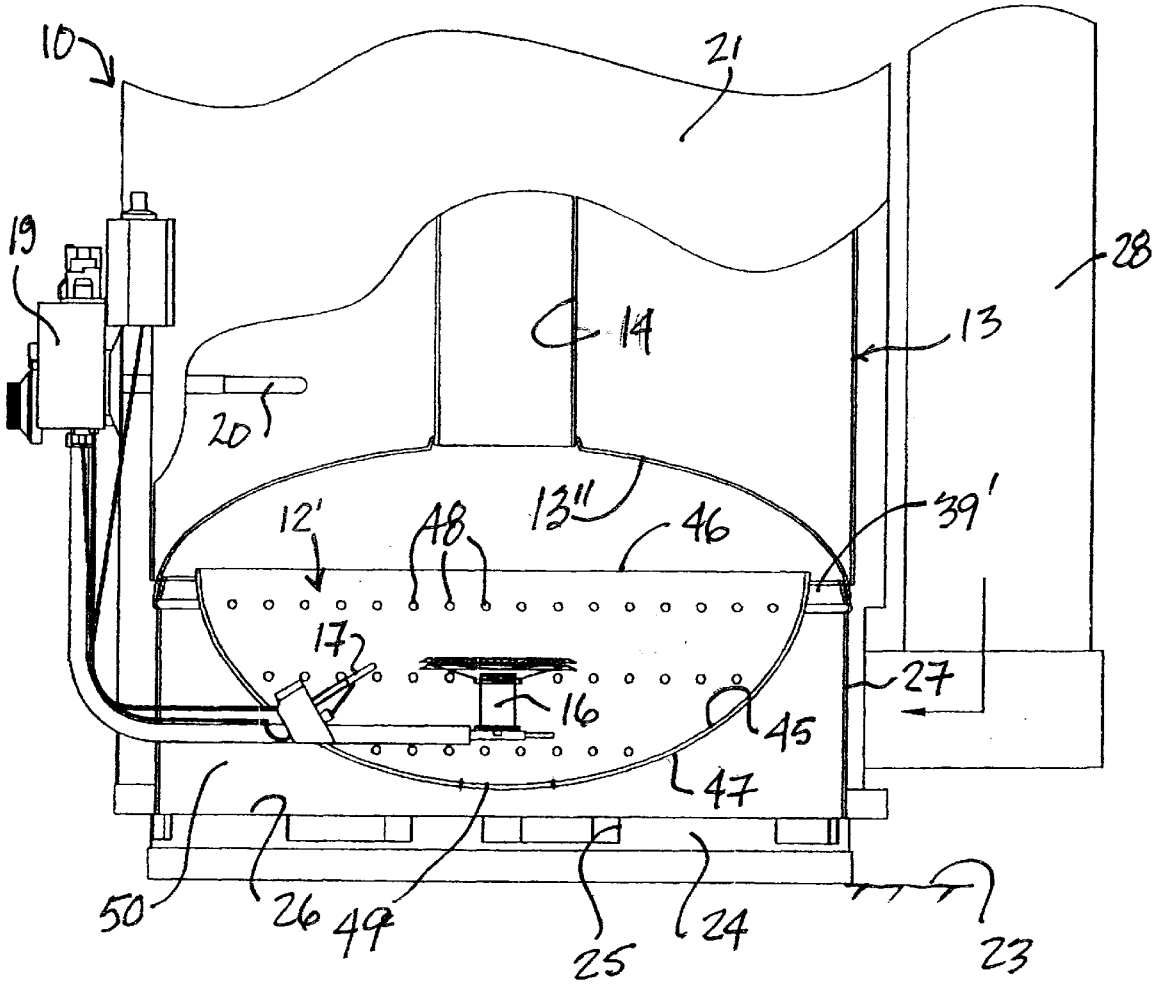
FIG. 2 is a view similar to FIG. 1 but showing a further example of the construction of the shield of the present invention.

The hot water heater is supported elevated from a support surface 23 by a support base 24 which is provided with vent holes 25 to provide air circulation under the bottom wall 26 of the housing which is in communication with the combustion chamber 11 which is hereinshown as a sealed combustion chamber, although not essential. Accordingly, it is desirable to have air circulation under this bottom wall. It is further pointed out that the entire hot water heater 10 may be supported elevated by other means such as a platform 23' as shown in FIG. 2, depending on the location of the air intake ports which supplies air for combustion. If the air intake is low, then it is preferable that the combustion chamber be elevated as high as possible from the ground surface 23 in the event that ignitable gas fumes may circulate over the ground surface 23, whereby to provide added security. The combustion chamber 11 may be a non-sealed combustion chamber wherein air is supplied thereto through the vent holes 25 in the support base 24. Accordingly, the vertical duct 28, as will be described later would not be required. As well, the bottom wall 26 would not be required or would have air openings therein.

A skirt 27 is disposed about the sealed combustion chamber 11 and spaced internally from a lower end portion 21' of the outer casing 21. Combustion air is supplied to the sealed combustion chamber by suitable means, and as herein shown by an elongated vertical duct 28, which is secured at a lower end 29 to the combustion chamber 11. The vertical duct 28 has a top inlet end 30 which is provided with aperture means, herein louvered openings 31 to admit air into the vertical duct to supply the combustion chamber. The inlet end 31 is elevated to reduce the risk of explosive gases entering the combustion chamber.

The present invention provides the heat shield 12 in the combustion chamber 11. As shown in the embodiment of FIG. 1, this heat shield 12 is a cup-shaped cylinder shield having a circular flat bottom wall 36 and a cylindrical side wall 37 secured to the outer periphery of the bottom wall 36 and projecting thereabove. The cylinder shield has an open top end 38 facing the heat transfer wall 13" of the inner casing 13. This heat transfer wall 13" is usually a concave dome-shaped wall with the flue 14 disposed centrally at the apex thereof. Spacing brackets 39 maintain the shield side wall 37 spaced from the skirt 27 and the bottom wall 36 spaced from the bottom wall 26 of the combustion chamber whereby to provide an air space 40 about the shield. The vertical duct 28 provides fresh combustion air in this space 40 to supply the burner. Air is drawn within the space 40 by the hot flame of the burner which creates a draft within the space about the shield 12 of the burner drawing air through the holes 41 and about the side walls 37 of the shield as well as over the top edge. This helps to cool the skirt 27 and the bottom wall 26. For example, the skirt 27 without the shield attained temperatures of about 350° F. and with the shield this has been reduced to 150° F.

As can be seen, the shield 12 is provided with a plurality of apertures or holes 41 in at least a bottom wall 36. Additional holes 41 may also be provided in the cylindrical side wall 37. As an alternative, a single large through-bore 42 may be provided centrally in the shield bottom wall 36 in line with the burner 16 which is supported elevated at the center inside the heat shield 12. This shield 12 provides heat concentration in the combustion chamber 11 and on the lower heat transfer wall 13' of the inner casing and reduces heat loss through the skirt 27 and the bottom end wall 26 of the combustion chamber.

Referring now to FIG. 2, there is shown a further example of the construction of the heat shield, herein identified by reference numeral 12'. As can be seen, this shield 12' is a bowl-like shield and therefore has the shape of an inverted dome which defines a concave inner surface 45 which faces the open top end 46 of the shield, and a convex outer surface 47 which is disposed spaced from the sealed bottom wall 26 of the combustion chamber and the skirt 27. The open top end 46 faces the heat transfer wall 13" of the inner casing and disposed concentrically below this heat transfer wall whereby heat radiation from the concave inner surface is concentrated on the heat transfer wall 13" to achieve better heat exchange between the inner casing and the combustion chamber.

The heat shield 12' is also provided with apertures 48 all around the inverted dome-shaped shield or alternatively a single large aperture 49 may be disposed at the apex of the dome and concentrically aligned with the burner 16, similar to the aperture 42 in the previous embodiment of the shield as above-described. The dome shield 12' is secured by the spacing brackets 39' similar to the embodiment of FIG. 1. As can be seen with this embodiment, the air space 50 surrounding the shield is much larger and this inverted dome-shape shield design enhances the heat concentration on the transfer wall and the reduction of heat loss through the skirt 27 and bottom end wall 26 of the sealed combustion housing. These shields are preferably, but not exclusively, formed of steel material capable of resisting the high temperature heat of the combustion chamber.

It is within the ambit of the present invention to cover any obvious modifications of the examples of the preferred embodiment described herein, provided such modifications fall within the scope of the appended claims.

What is claimed is:

1. A shield for gas-fired a combustion chamber of a hot water heater, said hot water heater having an inner casing for the containment of water to be heated by a combustion chamber disposed under said inner casing, a burner and pilot in said combustion chamber, a flue pipe extending from said combustion chamber to evacuate combustion gases, an outer casing secured spaced about said internal casing and insulated therefrom by a thermal insulating material, a support base at a bottom end of said water heater, a skirt about said combustion chamber spaced internally from a lower end portion of said outer casing, air passage means to supply air to said combustion chamber, and a heat shield formed of metal in said combustion chamber encircling and spaced under and to the sides of said burner and pilot, said shield being spaced from said skirt, air aperture means in said shield and disposed under and to the sides of said burner and pilot to permit passage of air supplied through said air passage means; said shield providing heat concentration in said combustion chamber and on a lower heat transfer wall of said inner casing, and reducing heat loss through said skirt and a bottom end of said combustion chamber.

2. A shield as claimed in claim 1 wherein said combustion chamber is a sealed combustion chamber, said passage means being an air channel means, said shield being spaced also from a bottom end wall of said combustion chamber.

3. A shield as claimed in claim 2 wherein said bottom end wall is supported elevated by said support base, said support base having vent holes to circulate air against said bottom end wall.

4. A shield as claimed in claim 3 wherein said channel means is a vertical duct connected at a lower end to an air supply space about said shield between said sealed bottom wall and said skirt, said vertical duct having a top inlet end spaced a predetermined distance from said support base to admit fresh air in said duct to supply said air supply space and burner.

5. A shield as claimed in claim 2 wherein said aperture means is one or more apertures formed in said heat shield.

6. A shield as claimed in claim 5 wherein said shield is a cup-shaped cylinder shield having a circular bottom wall, a cylindrical side wall secured to a periphery of said bottom wall and projecting thereabove, and an open top end facing said heat transfer wall of said inner casing.

7. A shield as claimed in claim 6 wherein said cylinder shield is secured by support means to position said cylinder shield spaced from said sealed bottom wall and said skirt to provide an air supply space about said shield, said channel means communicating with said air supply space.

8. A shield as claimed in claim 7 wherein said air aperture means is constituted by a single large central aperture formed in said circular bottom wall, said burner being supported above said central aperture and concentrically spaced from said circular side wall.

9. A shield as claimed in claim 7 wherein said air aperture means is constituted by a plurality of holes provided in said circular bottom wall and said cylindrical side wall.

10. A shield as claimed in claim 5 wherein said shield is an inverted dome-shaped shield defining a concave inner surface facing an open top end thereof and a convex outer surface disposed spaced from said sealed bottom wall and said skirt, said open top end facing said heat transfer wall of said inner casing.

11. A shield as claimed in claim 10 wherein said heat transfer wall of said inner casing is a concave wall, said shield being secured concentrically below said heat transfer wall whereby heat radiation from said concave inner surface will be concentrated on said heat transfer wall.

12. A shield as claimed in claim 11 wherein said air aperture means is constituted by a single large central aperture formed in said inverted dome-shaped shield at an apex thereof, said burner being supported above said central aperture.

13. A shield as claimed in claim 11 wherein said air aperture means is constituted by a plurality of holes provided in said inverted dome-shaped shield.

14. A shield as claimed in claim 1 wherein said passage means is constituted by apertures formed in a support base of said hot water heater.

* * * * *